US010648763B2

(12) United States Patent
Chia et al.

(10) Patent No.: US 10,648,763 B2
(45) Date of Patent: May 12, 2020

(54) EASY LOADING TOY PROJECTILE LAUNCHER

(71) Applicant: Easebon Services Limited, Kwun Tong (HK)

(72) Inventors: Francis See Chong Chia, Kowloon (HK); Steven J. Huebl, Jordon, MN (US)

(73) Assignee: Easebon Services Limited, Kwun Tong (HK)

( * ) Notice: Subject to any disclaimer, the term of this patent is extended or adjusted under 35 U.S.C. 154(b) by 0 days.

(21) Appl. No.: 15/850,130

(22) Filed: Dec. 21, 2017

(65) Prior Publication Data

US 2019/0195592 A1 Jun. 27, 2019

(51) Int. Cl.
*F41B 7/00* (2006.01)
*F41B 4/00* (2006.01)
*F41B 11/52* (2013.01)

(52) U.S. Cl.
CPC ..... *F41B 7/006* (2013.01); *F41B 4/00* (2013.01); *F41B 11/52* (2013.01); *F41B 7/003* (2013.01)

(58) Field of Classification Search
CPC .... F41B 4/00; F41B 7/08; F41B 11/50; F41B 11/52; F41B 11/53; F41B 11/54; F41B 11/55; F41B 11/89; F41B 7/006
USPC ..... 124/45, 49, 51.1, 52, 78
See application file for complete search history.

(56) References Cited

U.S. PATENT DOCUMENTS 2,753,977 A 7/1956 Ransohoff
4,168,695 A 9/1979 Haller et al.
5,282,454 A * 2/1994 Bell ..... F41A 9/48 124/49
5,373,832 A * 12/1994 D'Andrade ..... F41B 11/54 124/59

(Continued)

FOREIGN PATENT DOCUMENTS

GB 2200899 A 8/1988

OTHER PUBLICATIONS

Bridge Breaker Flow Aid, Thayer Scale, http:www.thayerscale.com/product/bridge-breakers-bin-discharger/, printed Sep. 25, 2017 (3 pp).

(Continued)

*Primary Examiner* — Alexander R Niconovich
(74) *Attorney, Agent, or Firm* — Amster, Rothstein & Ebenstein LLP

(57) ABSTRACT

A toy projectile launcher capable of launching a substantially large number of projectiles, for example, toy foam darts. To increase the number of projectiles that can be launched between reloadings, the projectiles are housed in a hopper. The hopper may include a movable rear wall which facilitates the loading of a large number of projectiles into the hopper at one time. A portion of a side wall of the hopper may be agitated to loosen the projectiles within the hopper so that they will drop into a firing chamber of the launcher more easily. A cover for the hopper may have a collapsible ceiling to prevent the projectiles from becoming improperly oriented in the hopper as they are being loosened by the agitated portion of the side wall of the hopper. A rotating track and a push rod may cooperate to advance projectiles from a firing chamber of the launcher.

26 Claims, 12 Drawing Sheets

(56) References Cited

U.S. PATENT DOCUMENTS 5,511,333 A * 4/1996 Farrell ..... F41B 11/55 221/310
5,515,837 A * 5/1996 Nin ..... F41B 11/723 124/59
5,522,374 A * 6/1996 Clayton ..... F41B 11/54 124/48
6,327,953 B1 * 12/2001 Andresen ..... F41A 9/02 124/45
6,408,837 B1 6/2002 Johnson et al.
6,415,781 B1 7/2002 Perrone
6,481,432 B2 * 11/2002 Rushton ..... F41B 11/57 124/49
6,488,019 B2 * 12/2002 Kotsiopoulos ..... F41B 11/57 124/51.1
6,644,293 B2 * 11/2003 Jong ..... A45F 5/02 124/52
6,915,792 B1 * 7/2005 Sheng ..... F41B 11/54 124/48
6,981,493 B1 * 1/2006 Poteracke ..... F41B 11/50 124/45
7,051,727 B2 * 5/2006 Wu ..... F41B 4/00 124/6
7,077,118 B2 * 7/2006 Lewis ..... F41B 11/50 124/45
7,270,121 B2 * 9/2007 Lubben ..... F41B 11/53 124/51.1
7,426,927 B1 * 9/2008 Broersma ..... F41B 11/52 124/49
7,640,924 B2 1/2010 Cherepanov
7,770,569 B2 * 8/2010 Andresen ..... F41B 11/53 124/51.1
8,021,208 B2 * 9/2011 Victor ..... F42B 12/745 124/45
8,047,190 B2 * 11/2011 Kaakkola ..... F41B 11/53 124/51.1
8,596,254 B2 * 12/2013 Brooks ..... F41B 7/003 124/52
8,695,579 B2 4/2014 Huebl
8,776,693 B2 * 7/2014 Toeckes ..... A62C 3/08 102/364
9,212,864 B2 * 12/2015 Christopher ..... F41B 11/53
9,557,136 B2 * 1/2017 Hedberg ..... F41B 11/52
9,658,027 B2 * 5/2017 Stevens ..... F41B 11/51
9,958,230 B1 * 5/2018 Nugent ..... F41B 4/00
2002/0081939 A1 * 6/2002 Hornsby ..... F41B 11/55 446/268
2003/0136795 A1 * 7/2003 Juan ..... F41B 11/52 221/198
2005/0252500 A1 * 11/2005 Morikawa ..... F41B 11/89 124/71
2007/0056573 A1 * 3/2007 Campo ..... F41B 11/53 124/49
2010/0095942 A1 * 4/2010 Kaakkola ..... F41B 11/53 124/48
2011/0067681 A1 * 3/2011 Stevens ..... F41A 9/50 124/51.1
2011/0271941 A1 * 11/2011 Meggs ..... F41A 9/70 124/65
2012/0037138 A1 * 2/2012 Huebl ..... F41A 9/26 124/56
2012/0103316 A1 * 5/2012 Kaakkola ..... F41B 11/53 124/51.1
2013/0112184 A1 * 5/2013 Corsiglia ..... F42B 6/00 124/78
2014/0283809 A1 * 9/2014 Huebl ..... F41B 11/54 124/65

OTHER PUBLICATIONS

Warpig Reloader 2, warpig.com, http://www.warpig.com/paintball/technical/loaders/reloader2/, printed Sep. 25, 2017 (5 pp).
IBC Discharge Unit, Direct Industry, http://www.directindustry.com/prod/mucon/product-111125-1093699.html, printed Sep. 25, 2017 (8 pp).

* cited by examiner

EASY LOADING TOY PROJECTILE LAUNCHER

FIELD

The present invention generally relates to a toy projectile launcher capable of launching a substantially large number of projectiles without reloading.

BACKGROUND

Toy guns that discharge soft projectiles, such as toy foam darts—commonly referred to as "launchers" or "shooters"—are well known in the art. A typical magazine that holds darts that are discharged by such launchers is a clip or a cartridge that has an open top, a closed bottom, and a biasing spring that biases the darts upwardly, from the bottom of the magazine to the top.

Currently, darts are loaded into empty magazines one dart at a time. The time and effort it takes to reload a launcher that can launch a multitude of darts in this manner is one of the most frustrating aspects of playing with a launcher. Specifically, during the time period that one is reloading a launcher, one is vulnerable to being shot at by one's opponents in a dart war game. This situation could be alleviated by carrying a spare magazine, a belt with a plurality of spare magazines, a drum, or some other source of spare darts. However, there is a limit to the number of spare magazines that one could carry.

Furthermore, although it also follows that a launcher that could launch a lot of darts will yield more fun between reloads, the downside to being able to launch a lot of darts is that it will take longer amount of time to reload the launcher. Thus, a key determinant to ensuring a pleasurable and satisfying experience when using a toy projectile launcher remains the amount time it takes to reload the launcher. Accordingly, a system for reducing the time required to reload a toy projectile launcher is desirable.

SUMMARY

The present invention generally relates to toy projectile launchers, and in embodiments, to a projectile launcher that enables a user to load the launcher simply by grabbing a handful of projectiles and dropping them into a container that leads directly to the firing chamber of the launcher.

According to an exemplary embodiment of the present invention, a toy projectile launcher includes a housing defining an interior recess and a hopper coupled to the interior recess of the housing. The hopper is configured to house one or more projectiles and to provide the one or more projectiles to the interior recess of the housing so that they can be launched from the housing. The hopper includes a wall and an agitating member that is associated with the wall and is configured to cause the one or more projectiles to move within the hopper.

In embodiments, an opening may be provided in the agitating member.

In embodiments, the toy projectile launcher may include a wheel having a finger extending therefrom, and the wheel may protrude through the opening in the agitating member.

In embodiments, the agitating member may be agitated as a result of contact between the finger and an edge of the opening in the agitating member.

In embodiments, the agitating member may slope downwardly from the wall to the housing to guide the one or more projectiles into the housing.

In embodiments, the interior recess of the housing may include a firing chamber, and the agitating member may guide the one or more projectiles into the firing chamber.

In embodiments, the firing chamber may include a rotating track to advance the one or more projectiles from the firing chamber.

In embodiments, the one or more projectiles may be provided to the interior recess of the housing one at a time.

In embodiments, the agitating member may be coupled to the wall by a hinge.

In embodiments, the one or more projectiles may include toy foam darts.

According to an exemplary embodiment of the present invention, a toy projectile launcher includes a housing defining an interior recess and a hopper coupled to the interior recess of the housing. The hopper is configured to house one or more projectiles and to provide the one or more projectiles to the housing so that they can be launched from the housing. The hopper includes a first wall, an agitating member associated with the first wall and configured to cause the one or more projectiles to move within the hopper, a cover having an underside which faces into the hopper, and a ceiling that is collapsibly attached to the underside of the cover.

In embodiments, the ceiling may include a plurality of nested members attached to the underside of the cover.

In embodiments, the plurality of nested members may expand into the hopper when the cover is closed.

In embodiments, the ceiling may rest on top of the one or more projectiles that are housed in the hopper.

In embodiments, the ceiling may include a spring attached to the underside of the cover.

According to an exemplary embodiment of the present invention, a toy projectile launcher includes a housing defining an interior recess and a hopper coupled to the interior recess of the housing. The hopper is configured to house one or more projectiles and to provide the one or more projectiles to the housing so that they can be launched from the housing. The hopper includes a wall that is movable to facilitate loading of the one or more projectiles into the hopper.

In embodiments, the wall may be rotatable about the housing for a predetermined distance.

In embodiments, the wall may be movable to a degree that accommodates entry of a partially closed fist of a user into the hopper.

In embodiments, the wall may be a rear wall of the hopper.

In embodiments, the toy projectile launcher may include a cover for the hopper that is rotatably coupled to the rear wall.

According to an exemplary embodiment of the present invention, a toy projectile launcher includes a housing defining an interior recess, a firing chamber disposed within the interior recess and configured to receive a projectile, a rotating track disposed at a bottom of the firing chamber to advance the projectile out of the firing chamber, and a push rod configured to enter the firing chamber. The push rod cooperates with the rotating track to advance the projectile from the firing chamber.

In embodiments, the push rod may push the projectile as the projectile is being advanced from the firing chamber by the rotating track.

In embodiments, a tip of the push rod may extend halfway into the firing chamber.

In embodiments, the push rod may be a reciprocating push rod.

In embodiments, the firing chamber may be configured to receive one projectile at a time.

BRIEF DESCRIPTION OF THE DRAWINGS

Various exemplary embodiments of this invention will be described in detail, with reference to the following figures, wherein.

DETAILED DESCRIPTION

Figure 1:
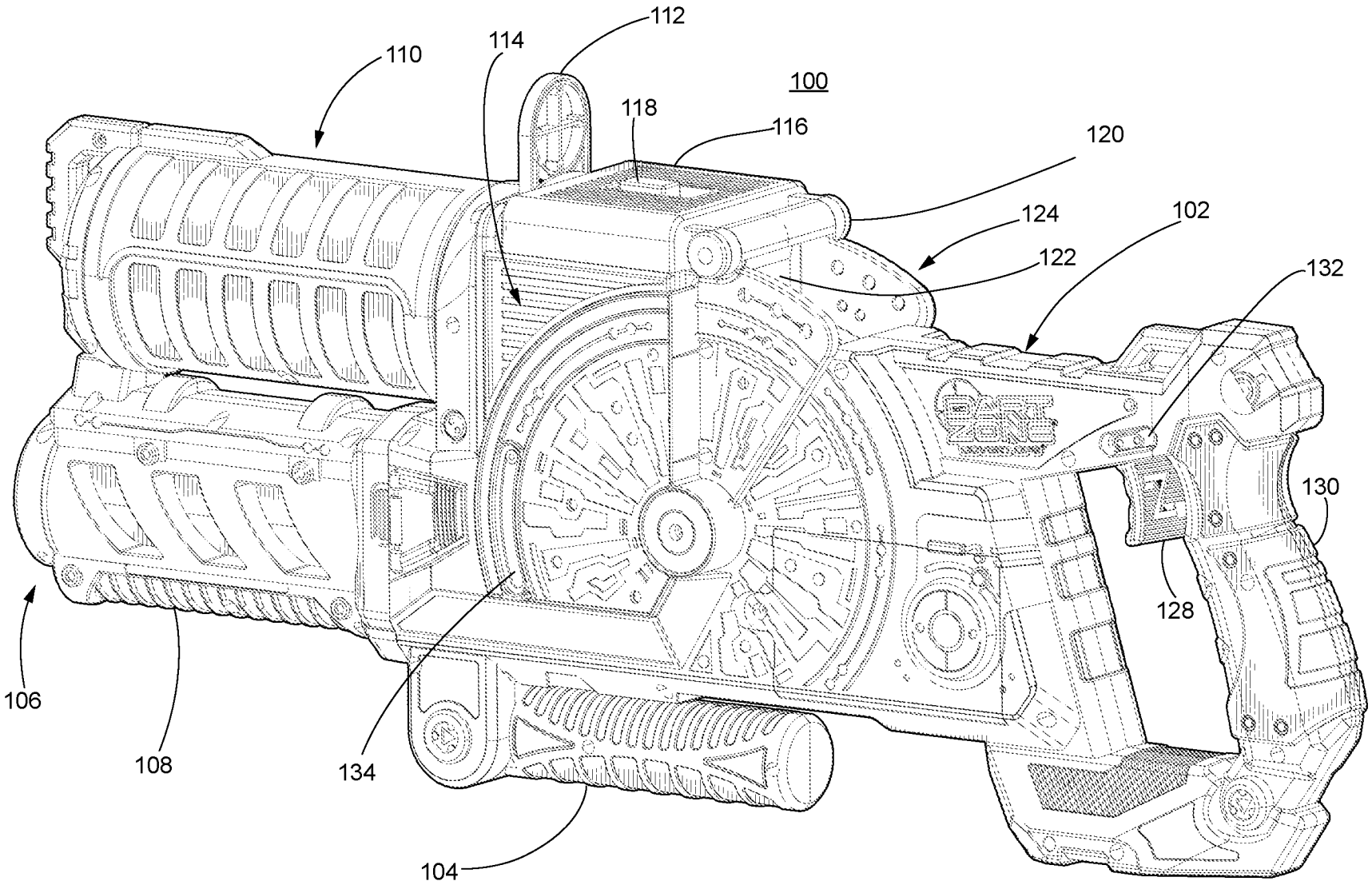
FIG. 1 shows a left side perspective view of a toy projectile launcher in accordance with exemplary embodiments of the present invention.
Figure 2:
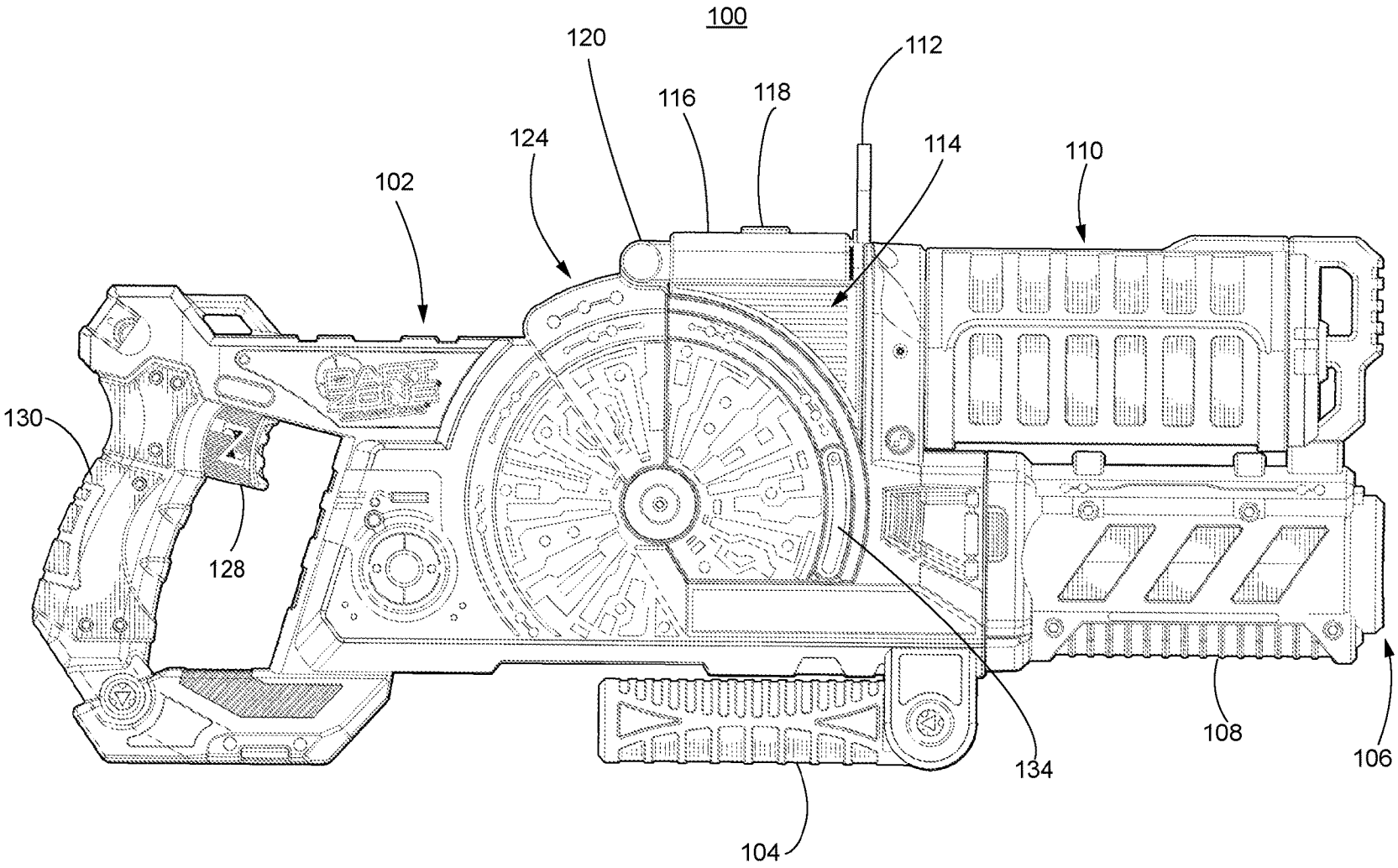
FIG. 2 shows a right side view of the toy projectile launcher shown in FIG. 1.
Figure 3:
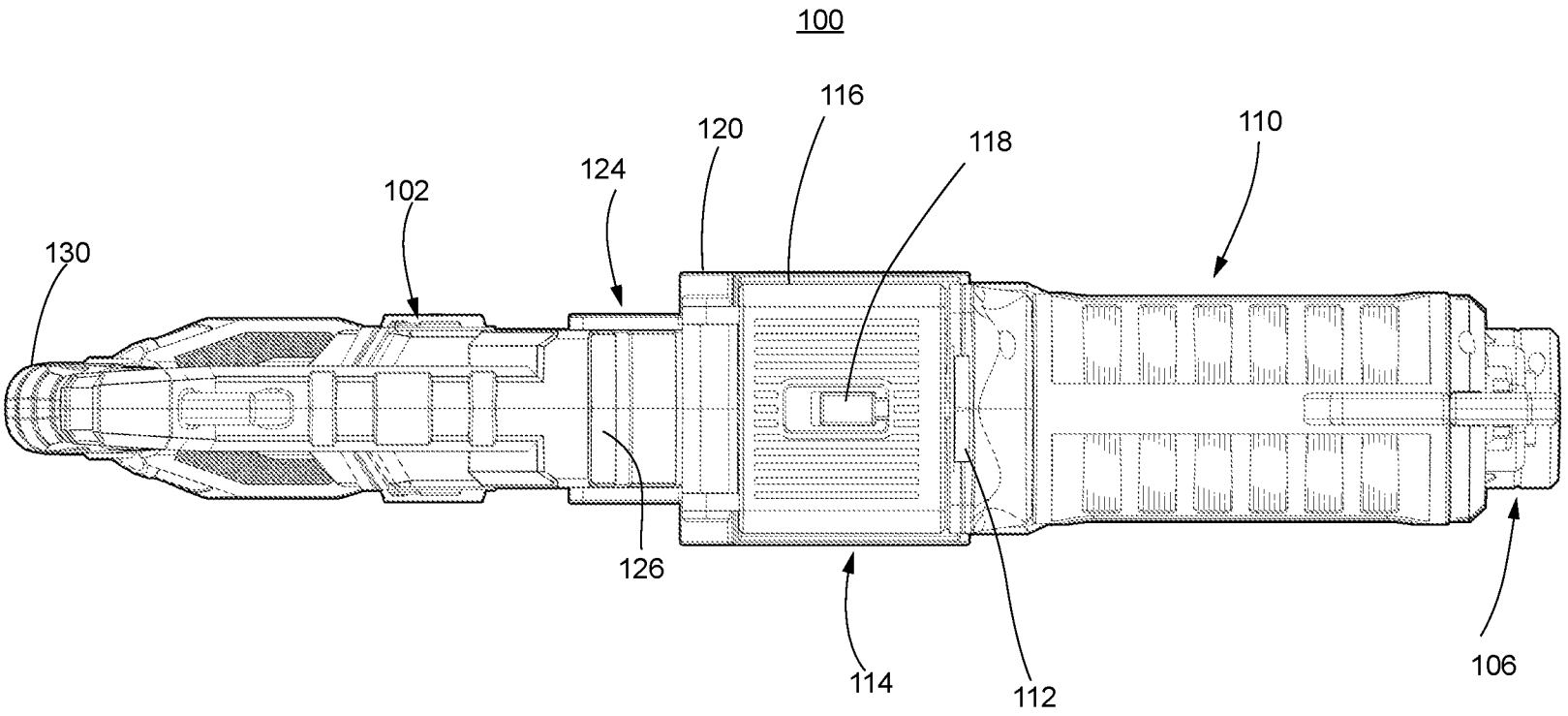
FIG. 3 shows a top view of the toy projectile launcher shown in FIG. 1.
Figure 4:
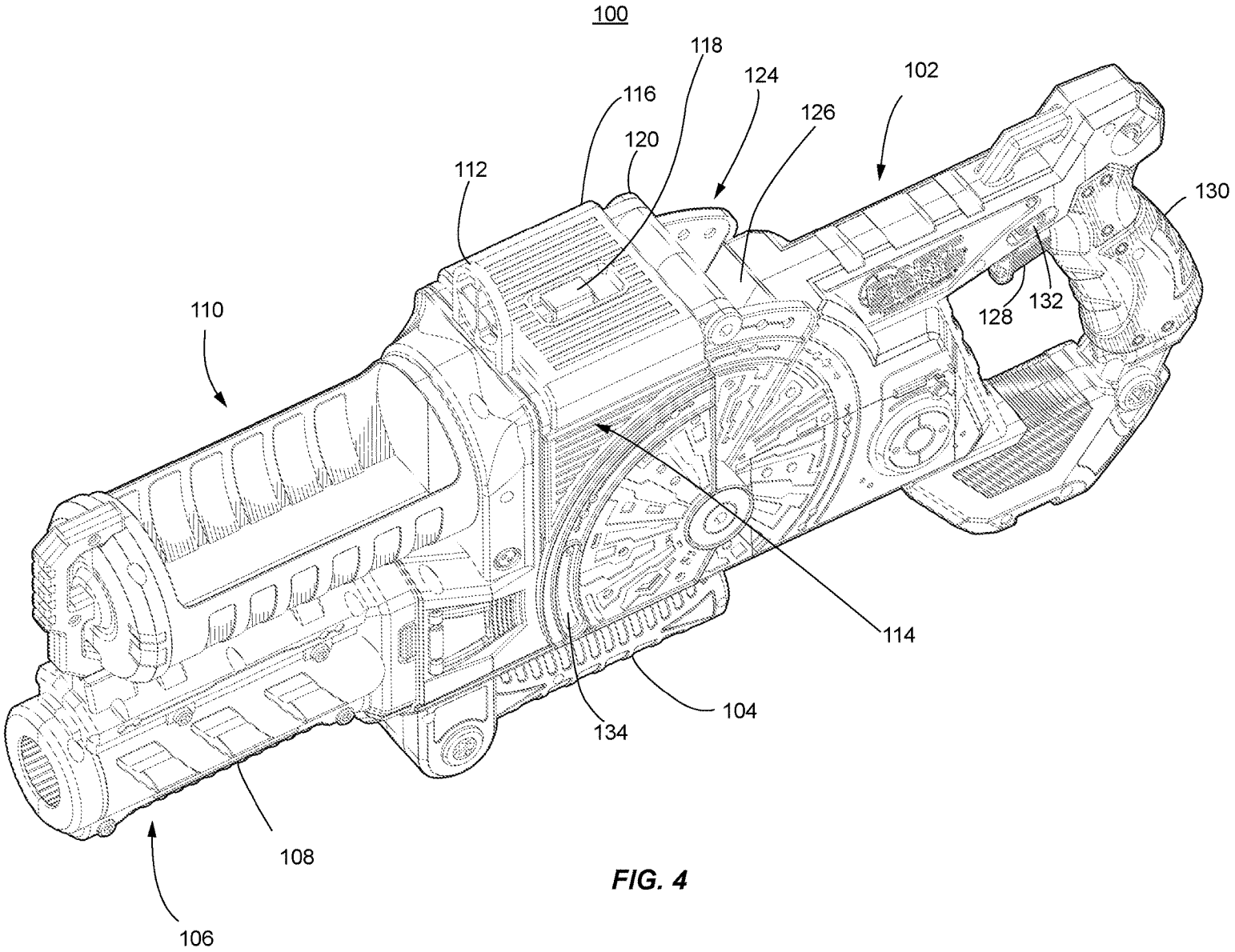
FIG. 4 shows a top, left side perspective view of the toy projectile launcher shown in FIG. 1.

The present invention is directed towards a projectile launcher—for example, a toy foam dart launcher—that is capable of launching a substantially large number of projectiles in rapid succession, thereby reducing the number of times needed to reload the projectile launcher. To increase the number of projectiles that can be launched between reloadings, the projectiles are housed in a hopper. The hopper may include a movable rear wall which facilitates the loading of a large number of projectiles into the hopper at one time. In addition, a portion of a side wall of the hopper may be agitated to loosen the projectiles within the hopper so that they will drop into a firing chamber of the toy projectile launcher more easily. Furthermore, a cover for the hopper may have a collapsible ceiling to prevent the projectiles from becoming improperly oriented in the hopper as they are being loosened by the agitated portion of the side wall of the hopper. These features, standing alone or in combination, enable a user to load the toy launcher with a substantially large number of projectiles, thus reducing the number of times the user must reload the toy launcher.

The use of hoppers and vibrating chutes is known in large-scale industrial manufacturing processes. For example, U.S. Pat. No. 2,753,977 ("the '977 patent"), entitled "Feeding Apparatus for Nail Weighing Machines," discloses a feed mechanism for a nail weighing machine. The feed mechanism includes a supply hopper which has an open top for receiving nails, an opening at its lower end through which nails are provided to a conveyor of the nail weighing machine, and side walls which incline downwardly toward one another in the direction of the lower-end opening. As described in the '977 patent, when nails are dumped into the supply hopper, the inclined nature of the side walls tends to cause the nails to jam between the side walls. To prevent the jamming of the nails between the side walls, the supply hopper 50 includes a vibrating panel or side wall located in the hopper.

However, such large-scale industrial hoppers do not teach the use of a hopper structure in the environment of a toy foam dart shooter. For instance, the hopper disclosed in the '977 patent provides nails to a vibrating conveyer. As such, the nails are not delivered to the nail weighing machine rapidly, and they are delivered without regard to the direction in which the nails are pointing. In contrast, in a toy foam dart shooter in accordance with embodiments of the present invention, it is critical to be able to deliver the darts into the firing chamber of the dart launcher as rapidly as possible and with their tips pointed toward the barrel of the launcher. Furthermore, in a typical magazine for a toy foam dart launcher (e.g., a clip or a cartridge), the darts are biased upwardly, from the bottom of the magazine to its top, for loading into the firing chamber of the launcher. Thus, toy dart launchers have heretofore not had a need to vibrate or shake a dart (or any other type of projectile or accessory) downwards, and providing such a capability would only increase the cost of the launcher (by requiring a battery-operated motor) without providing any benefit.

It was not until the present invention that the applicability and advantages of the novel use of a hopper structure, and related features, have been recognized and appreciated in the context of a toy foam dart shooter. As described in detail below, a toy foam dart launcher in accordance with embodiments of the present invention advantageously employs a hopper structure to enable a user to load a toy dart launcher with a substantially large number of projectiles more quickly and more easily.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

Referring to FIGS. 1-6, a toy projectile launcher 100 may be configured to launch one or more projectiles (not shown) therefrom. In embodiments, the projectiles may be non-lethal projectiles for use in recreational activities, and may be, for example, darts, arrows, balls, and/or discs, to name a few, in any combination or separation. The projectiles may include one or more performance-enhancing and/or decorative features, for example, suction cups, fins, whistles and/or other sound generating devices, one or more fluid-retaining portions, dyes or other transferable colorants, and/or collapsible portions, to name a few.

The projectiles may be formed of a lightweight and/or force-dampening material such as foam, rubber, or the like, so that the projectiles are suitable for use in play and/or sport activities involving, for example, children. In this manner, the projectiles are configured to impact a target, such as a portion of a human body, an animal, or an inanimate object without causing discomfort, pain, and/or damage thereto. In exemplary embodiments, the projectiles may be toy foam darts of the type described in U.S. Pat. No. 9,285,194 entitled "Foam Dart Having a Safety Cap," the entire contents of which are incorporated by reference herein. For convenience, the following description of projectile launcher 100 assumes that the projectiles are toy foam darts.

Figure 7A:
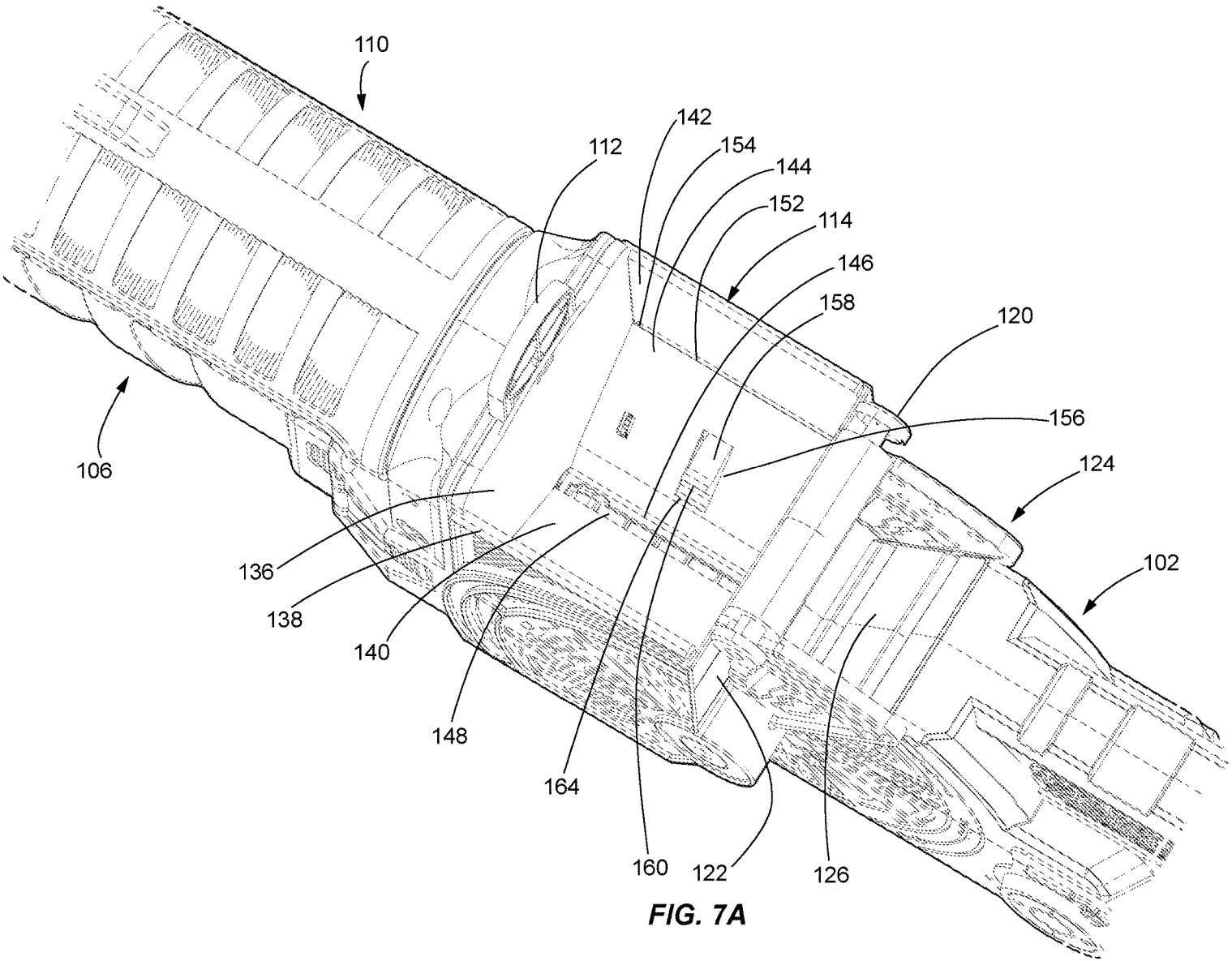
FIGS. 7A, 7B, and 7C illustratively depict various elements of the toy projectile launcher in accordance with exemplary embodiments of the present invention.
Figure 7C:
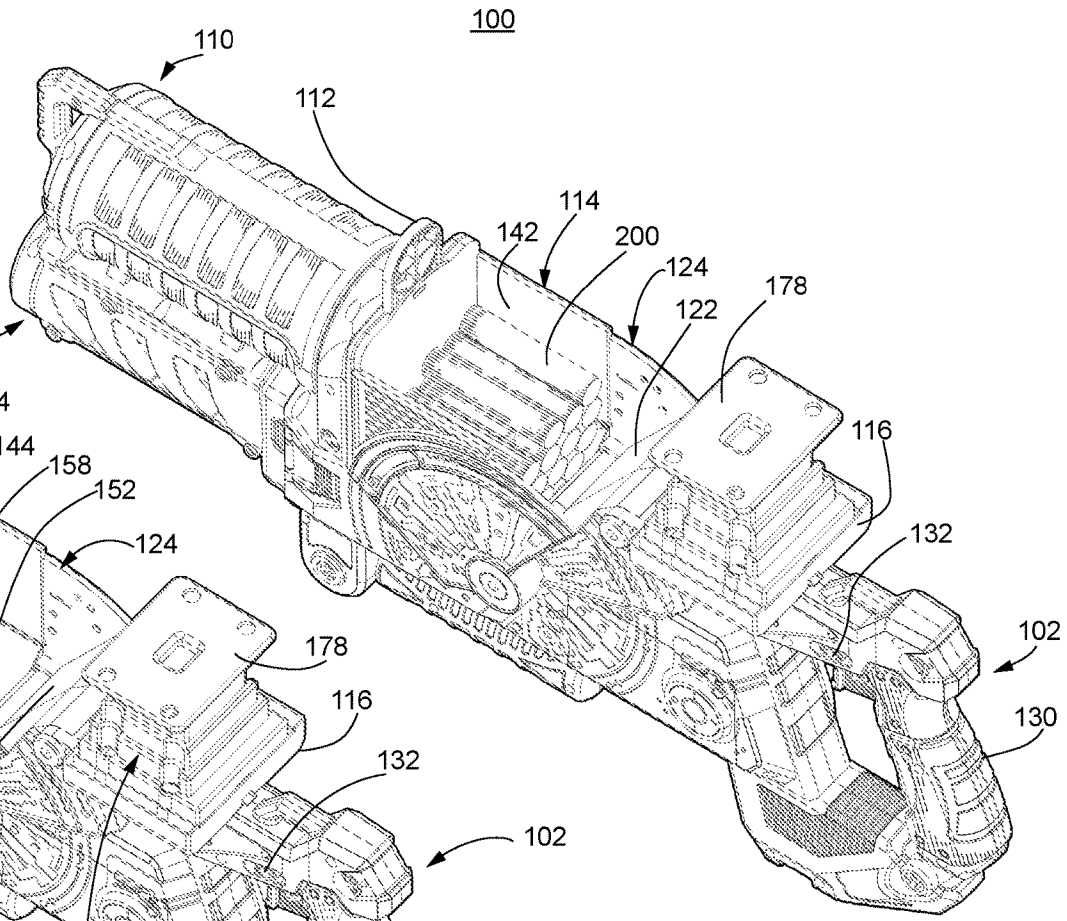
Figure 7B:
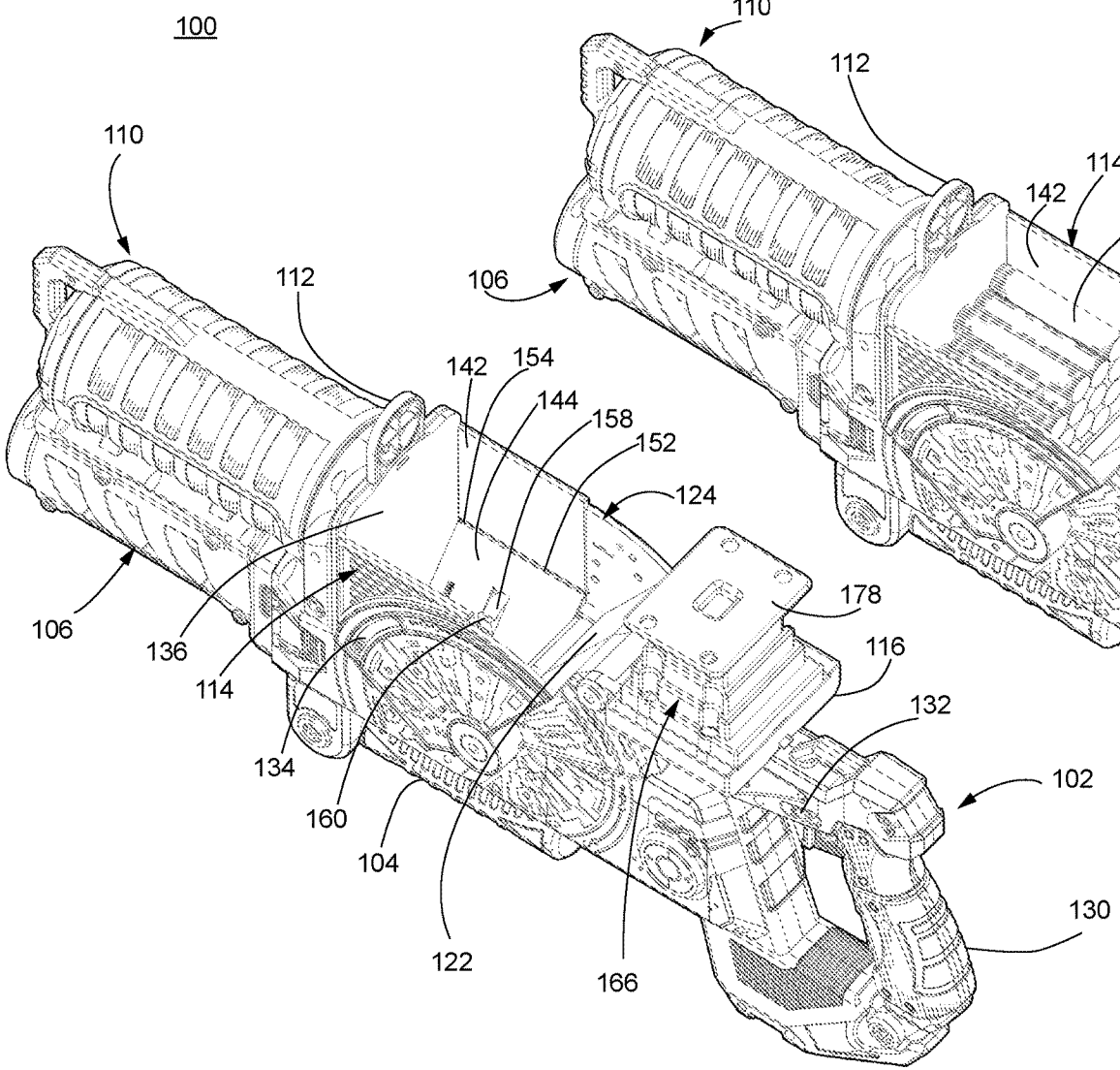
Figure 8:
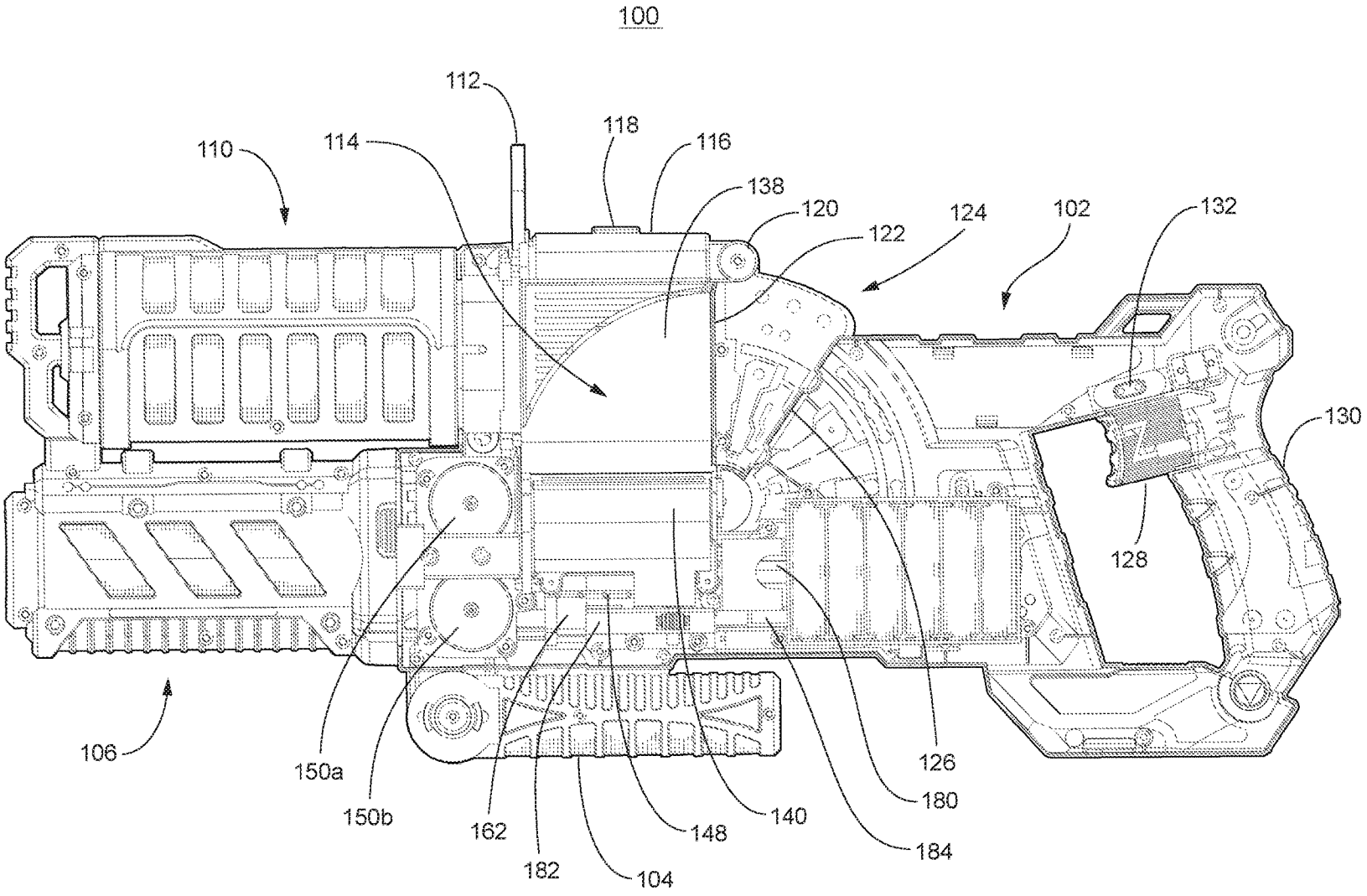
FIG. 8 illustratively depicts various elements of the toy projectile launcher in accordance with exemplary embodiments of the present invention.
Figure 9:
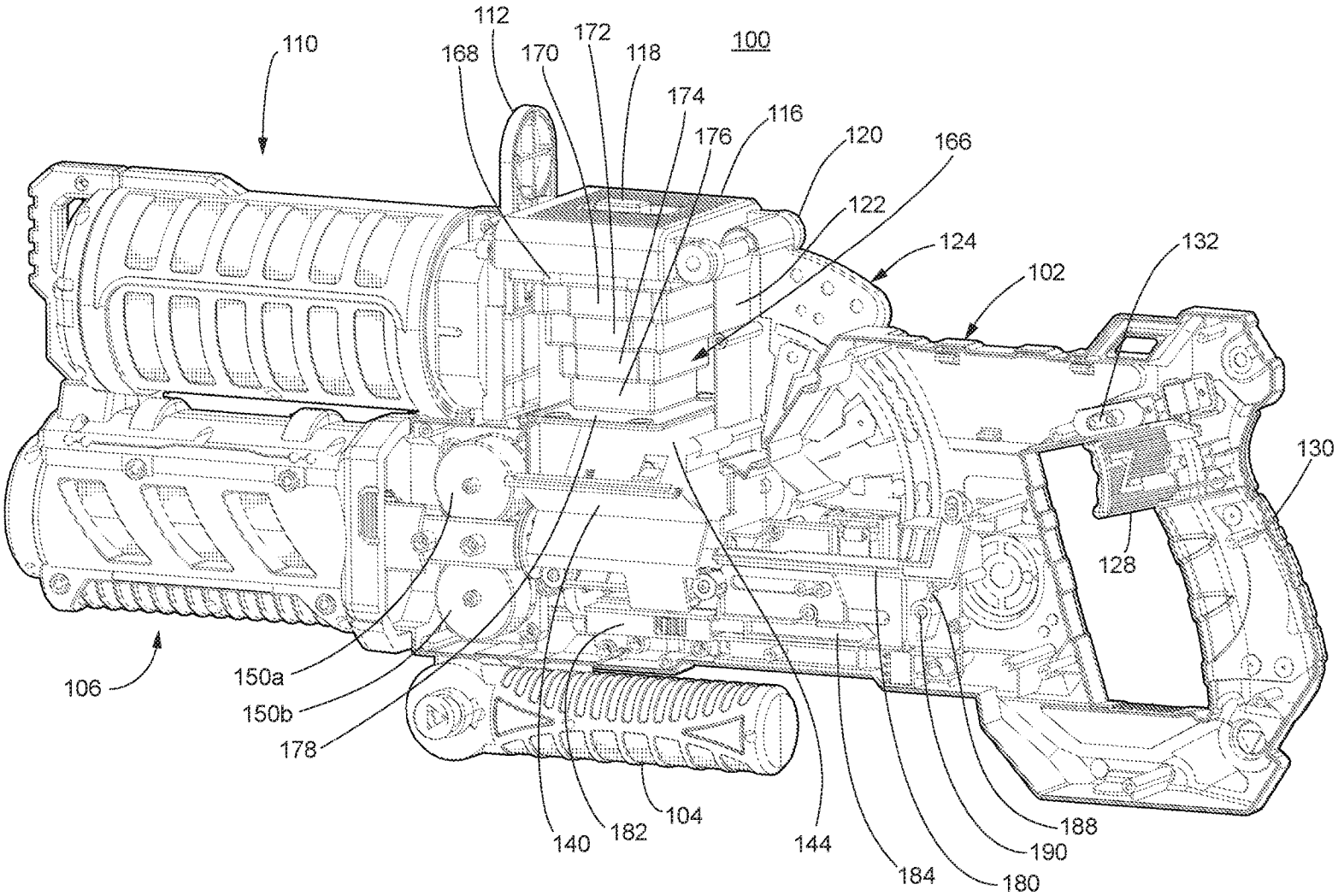
FIG. 9 illustratively depicts various elements arranged in an interior recess of the housing of the toy projectile launcher in accordance with exemplary embodiments of the present invention.

Projectile launcher 100 includes a housing 102. In embodiments, housing 102 may include various external handling or mounting structures, such as a retractable forward grip 104, a detachable barrel 106, a storage compartment 110 for storing extra projectiles, and a sighting member 112. Barrel 106 may include an underside grip 108. As shown in FIGS. 7A and 8, housing 102 has a hollow interior recess to accommodate the internal components of launcher 100.

Figure 5:
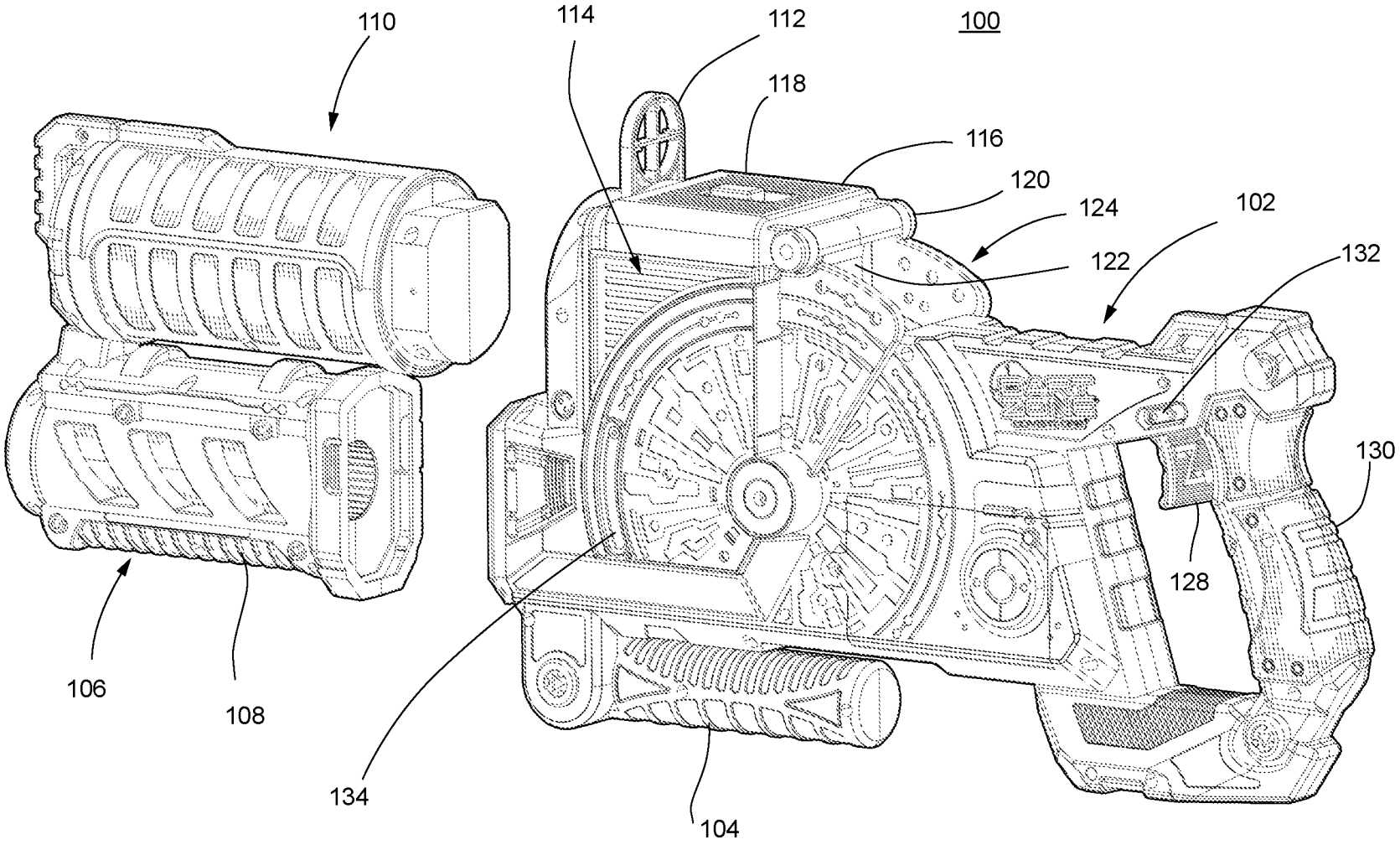
FIG. 5 shows an exploded view of the toy projectile launcher shown in FIG. 1.
Figure 6:
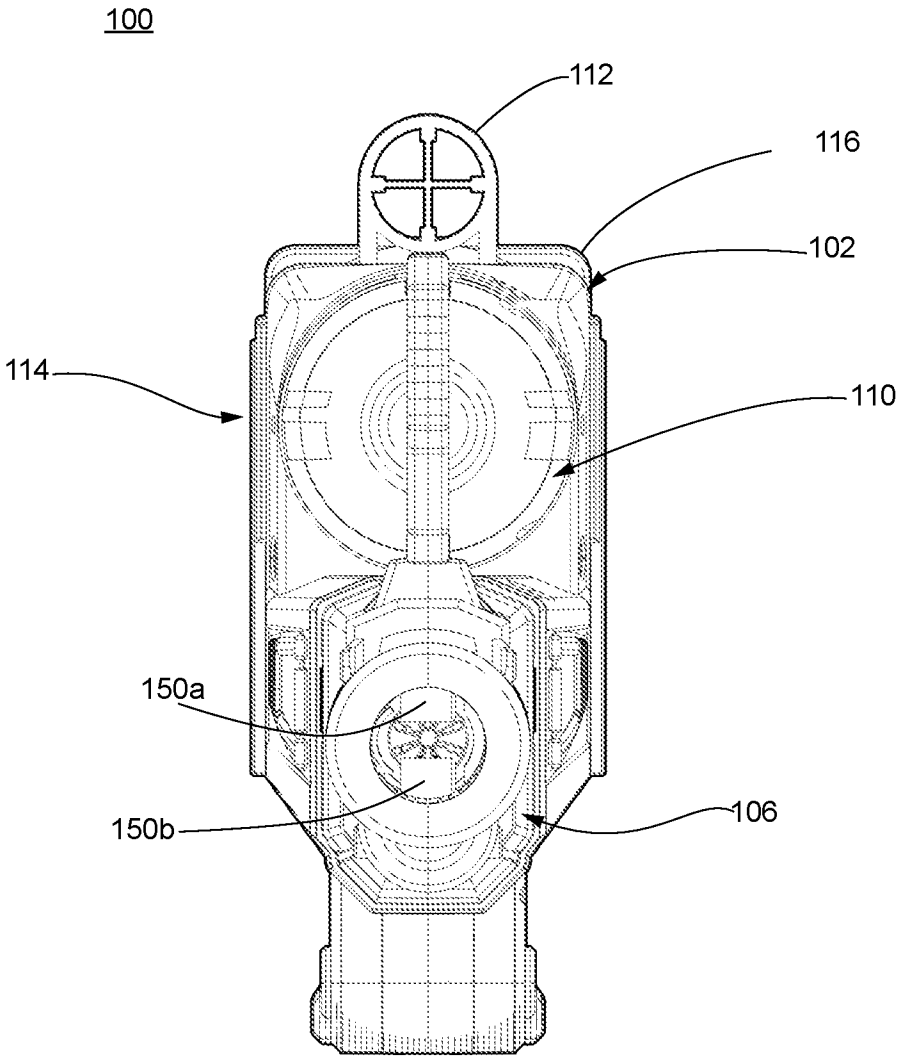
FIG. 6 shows a front view of the toy projectile launcher shown in FIG. 1.

As shown in FIG. 5, barrel 106 and storage compartment 110, and various other external structures, may be attached and/or connected and/or interfit and/or otherwise detachably coupled with housing 102. In alternative embodiments, barrel 106, underside grip 108, storage compartment 110, and various other external structures may be monolithically formed with the housing 102 of projectile launcher 100. In embodiments, the housing 102 may also be configured to receive various accessories for projectile launcher 100, for example, a scope, and/or a source of illumination, to name just a few additional accessories.

Referring now to FIGS. 5 and 7A, in exemplary embodiments, projectile launcher 100 includes a hopper 114 to house darts that will be launched from projectile launcher 100 through barrel 106. Hopper 114 is enclosed by a cover 116, a front wall 136, side walls 138 and 142, and a portion 122 of a movable rear wall assembly 124. As described in detail below, movable rear wall assembly 124 facilitates the loading of darts into the hopper 114. Cover 116 sits atop hopper 114, and is rotatably coupled to rear wall assembly 124 by hinge 120. Cover 116 is locked in place by pushing switch 118 forward (i.e., toward sighting member 112).

To load darts into hopper 114, the user first unlocks cover 116 by moving switch 118 backwards (i.e., toward hinge 120). The user then rotates cover 116 backwards around hinge 120, and opens rear wall assembly 124 by moving it backwards (i.e., towards rear grip 130). Rear wall assembly 124 rotates about housing 102 for a distance determined by its arcuate slots 134, until portion 122 of rear wall assembly 124 rests against portion 126 of housing 102.

With hopper 114 now open, the user can grab a handful of toy foam darts in his or her fist. In exemplary embodiments, the user can grab a maximum of about five foam darts at a time and, with the front of launcher 100 pointed downwards at a slight angle, place the darts in hopper 114 with the tips of the darts pointing toward the front of launcher 100 (i.e., toward barrel 106). (Since the tip of a dart is heavier than its foam body, the dart tips will be placed into hopper 114 first. Pointing the front of launcher 100 downwards at a slight angle thus allows the front wall 136 of hopper 114 to align the toy foam darts appropriately.) In exemplary embodiments, a maximum of forty darts can be loaded into the hopper 114 in this manner. Once a desired quantity of darts is loaded into hopper 114, the user pushes rear wall assembly 124 forward until portion 122 of rear wall assembly 124 sits flush against hopper 114, flips cover 116 around hinge 120 and back into place atop hopper 114, and locks cover 116 and rear wall assembly 124 into place by moving switch 118 forwards (i.e., toward sighting member 112).

As shown in FIGS. 5 and 7A-7C, the use of movable rear wall assembly 124 greatly facilitates rapid loading of the darts 200 into hopper 114. Specifically, when a user grabs a handful of darts 200, his or her fist is in a generally closed position. When the user inserts his or her closed fist into hopper 114 to deposit the darts 200 therein, with the tips of the darts pointing forward (i.e., toward barrel 106), the width of hopper 114 must be sufficiently large to ensure sufficient clearance. This poses a problem, however, because a wide container means a deep display package for launcher 100, which is uneconomical because it increases the costs associated with shipping commercial quantities of launcher 100. By providing a rear wall assembly 124 for hopper 114 which is capable of opening and closing as described above, it becomes possible for the partially closed fist of a user to enter hopper 114 to deposit darts 200.

Referring now to FIGS. 7A-7C, 8, and 9, hopper 114 includes front wall 136 and side walls 138, 142. A first projectile guide member 140 slopes downwardly from the bottom of side wall 138 toward firing chamber 146. Similarly, a second projectile guide member 144 slopes downwardly from the bottom of side wall 142 toward firing chamber 146. In embodiments, the slope angle of first projectile guide member 140 with respect to side wall 138 may be approximately equal to the slope angle of second projectile guide member 144 with respect to side wall 142.

First and second projectile guide members 140, 144, along with rotating rubber track 148, cooperate to define a firing chamber 146 at the bottom of hopper 114. In exemplary embodiments, the dimensions of firing chamber 146 are such that it accepts a single projectile at a time.

In operation, and as described above, a user loads toy foam darts into hopper 114 by opening and closing cover 116 and rear wall assembly 124. Due to gravity, and guided by first and second projectile guide members 140, 144, the darts housed in hopper 114 drop down into firing chamber 146 one at a time as successive darts are launched from launcher 100.

Figure 10:
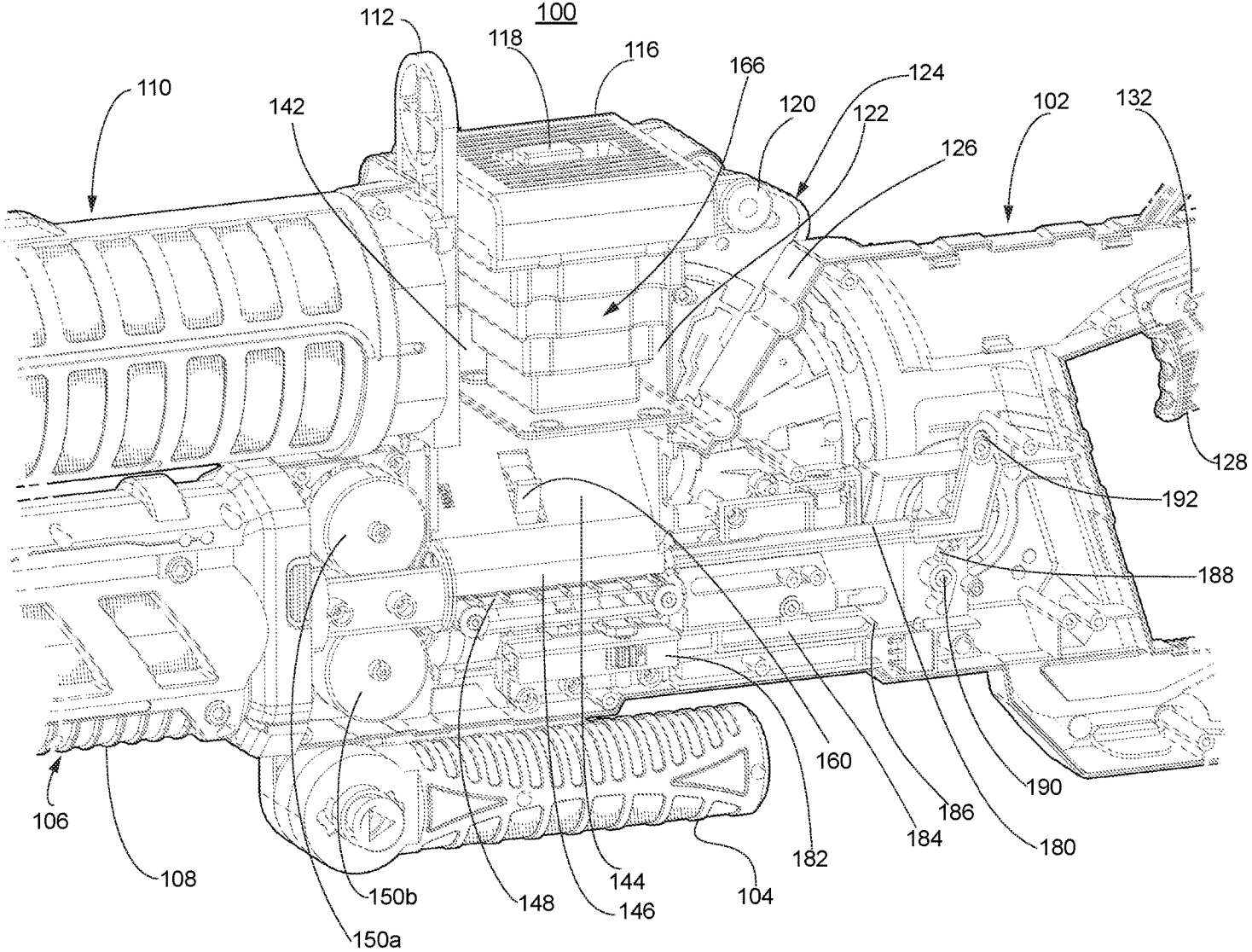
FIG. 10 illustratively depicts various elements of the toy projectile launcher in accordance with exemplary embodiments of the present invention.

In exemplary embodiments, when a toy foam dart is located in firing chamber 146, and the user pulls trigger 128, the dart is automatically delivered to a pair of spinning flywheels 150*a*, 150*b* using rotating rubber track 148 assisted by a reciprocating push rod 180. Referring to FIG. 10, as rubber track 148 rotates to advance a dart (not shown) from firing chamber 146 toward flywheels 150*a*, 150*b*, cam 182 pushes follower 184 back until tapered edge 186 contacts arm 188. This contact causes arm 188 to rotate counterclockwise about pivot 190. Arm 188 is mechanically coupled to push rod 180 at opening 192 such that the counterclockwise rotation of arm 188 about pivot 190 moves push rod 180 forward, thereby pushing the dart in firing chamber 146 from the rear as it is being advanced toward flywheels 150*a*, 150*b* by rotating rubber track 148. In exemplary embodiments, the tip of push rod 180 may reach halfway along the length of firing chamber 146 when fully extended. The reciprocating action of push rod 180 is completed when cam 182 pulls follower 184 back, allowing arm 188 to rotate clockwise about pivot 190 and, consequently, returning push rod 180 to its initial position.

Using rotating rubber track 148 in combination with reciprocating push rod 180 to deliver a dart from firing chamber 146 to flywheels 150*a*, 150*b* advantageously increases the speed with which the darts are delivered and overcomes the pressure applied to the dart in firing chamber 146 from those darts located above it in hopper 114. In this way, launcher 100 can shoots darts as fast as they can drop into firing chamber 146 from hopper 114.

When energized, upper flywheel 150*a* rotates clockwise and lower flywheel 150*b* rotates counterclockwise. In exemplary embodiments, both flywheels 150*a*, 150*b* may be energized when the user switches on/off switch 132 of launcher 100 into the "on" position. In embodiments, both flywheels 150*a*, 150*b* may be energized when the user pulls the trigger 128 of launcher 100. In embodiments, both flywheels 150*a*, 150*b* rotate at the same rotational velocity.

The physical construction of the darts can affect the ease with which the darts drop down from hopper 114 into single firing chamber 146. Specifically, the foam surfaces of the darts, in addition to the soft rubber or plastic tips of the darts, can cause friction among the darts that are housed in hopper 114. As a result, the darts may tend to jam together inside hopper 114, and thus they may not fall freely into single firing chamber 146. This tendency may be exacerbated when, as shown in FIG. 7A, first projectile guide member 140 and second projectile guide member 144 slope downwardly together to guide the darts toward firing chamber 146.

It can be frustrating to a user of a toy foam dart launcher to line up a perfect shot only to "fire a blank" due to a jam occurring in hopper 114. Although the user could simply manually loosen the darts housed in hopper 114 by shaking launcher 100, this option is inconvenient. A preferable approach is to agitate hopper 114, but agitating the entire hopper 114 is not without problems. For one thing, a vibrating hopper 114 would generate a lot of vibration, which would be distracting and would become annoying to the user very quickly. In addition, vibrating the entire hopper 114 is a more complicated, and thus more costly, solution. Furthermore, vibrating the entire hopper 114 does not completely solve the problem of ensuring that each dart in hopper 114 is provided precisely into the single firing chamber 146.

Figure 11:
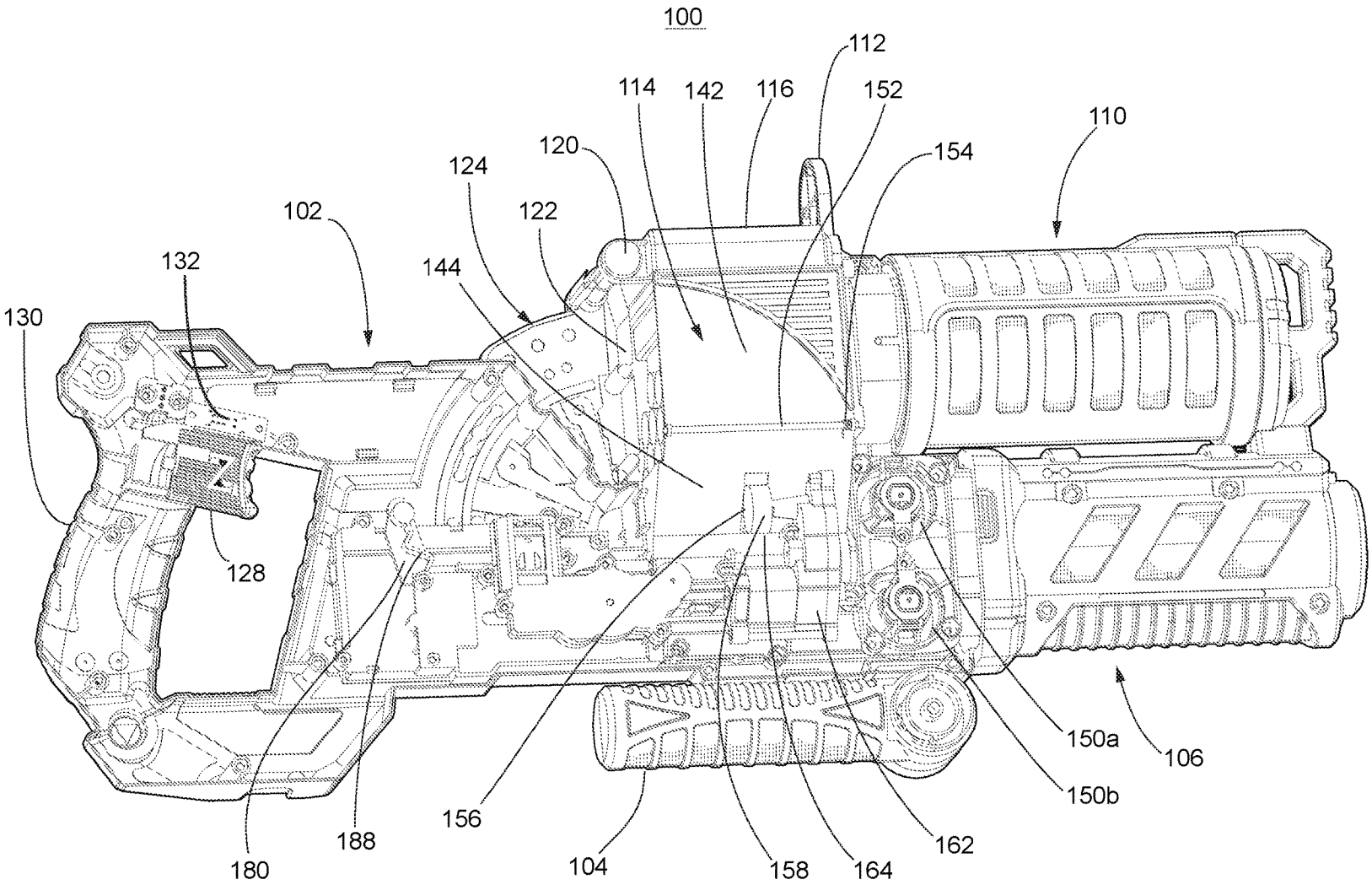
FIG. 11 illustratively depicts various elements of the toy projectile launcher in accordance with exemplary embodiments of the present invention.

The inventor has determined that the simplest and most cost-effective solution to the aforementioned problem is to agitate only one portion of hopper 114. In exemplary embodiments, one portion of hopper 114 is agitated (e.g., moved up and down) to thereby loosen the darts in the hopper 114 so that they can fall freely into the single firing chamber 146. As shown in FIG. 11, in exemplary embodiments, second projectile guide member 144 is movably coupled to side wall 142, e.g., by a hinge 152. A torsion spring 154 is provided at one end of hinge 152. Second projectile guide member 144 includes an opening 156.

As shown in FIGS. 7A, 10, and 11, a wheel 158 protrudes through opening 156 of second projectile guide member 144. As shown in FIGS. 7A and 10, in embodiments, a finger 160 extends from the rim of wheel 158. In exemplary embodiments, finger 160 may be integrally formed with wheel 158. As shown in FIG. 11, in embodiments, wheel 158 is mechanically coupled to, and thus made to turn by, an electric motor 162 which is energized when the user pulls the trigger 128 of launcher 100.

In operation, prior to the time when a user pulls trigger 128, second projectile guide member 144 is disposed in a position that is defined by the unbiased position of torsion spring 154. When a user pulls trigger 128, motor 162 causes wheel 158 to turn. As wheel 158 turns, finger 160 periodically comes into contact with a bottom edge 164 of opening 156 of second projectile guide member 144. In embodiments, finger 160 and bottom edge 164 may have complementary beveled edges that facilitate contact therebetween. When finger 160 contacts bottom edge 164, finger 160 presses down on second projectile guide member 144, thereby winding torsion spring 154 as second projectile guide member 144 rotates downwardly on hinge 152.

Once finger 160 is no longer in contact with bottom edge 164 of opening 156, torsion spring 154 unwinds back to its unbiased position. In so doing, torsion spring 154 provides a return force to second projectile guide member 144, which causes second projectile guide member 144 to "kick" (i.e., lift) up slightly on hinge 152. This "kicking" up of second projectile guide member 144 is enough to shake the darts in hopper 114 loose so that one of them will fall into single dart chamber 146 at the bottom of hopper 114. As described above, once a dart falls in dart chamber 146, rotating track 148, with the assistance of reciprocating push rod 180, delivers the dart to flywheels 150*a*, 150*b*.

In embodiments, second projectile guide member 144 may include a horizontal ridge, and a cam mechanism may be coupled to the horizontal ridge to agitate second projectile guide member 144 to shake the darts in hopper 114 loose. It will be understood by those of ordinary skill in the art that any of a number of other means can be used to agitate second projectile guide member 144 in accordance with the present invention. In embodiments, first projectile guide member 140, rather than second projectile guide member 144, may be agitated to loosen the darts in hopper 114.

As they are being shaken loose by the "kicking" action of second projectile guide member 144, the darts tend to jump up and down within hopper 114. If the darts do not come back down with their tips pointing forward (i.e., toward barrel 106), they will not launch properly from launcher 100 and, consequently, their trajectories will be distorted. Specifically, the darts will not shoot far, and they will not shoot accurately.

In embodiments of launcher 100, cover 116 includes a collapsible ceiling assembly 166 which is attached to the underside of cover 116 by any suitable means that is well known to those of ordinary skill in the art, and thus will not be described further herein. In an exemplary embodiment shown in FIGS. 9 and 10, collapsible ceiling assembly 166 includes a plurality of nested members 168, 170, 172, 174, 176. When collapsible ceiling assembly 166 is collapsed, each one of nested members 168, 170, 172, 174 may be contained within the nested member that is immediately above it. When collapsible ceiling assembly 166 is fully collapsed against the underside of cover 116, nested members 168, 170, 172, 174 are all contained within nested member 168. A descending ceiling plate 178 is attached to nested member 176 by any suitable means that are well known to those of ordinary skill in the art and thus will not be described further herein. In embodiments, the shape of descending ceiling plate 178 will generally conform to the shape of hopper 114. In exemplary embodiments, descending ceiling plate 178 will have a generally square or rectangular shape.

Collapsible ceiling assembly 166 ensures that if the darts in hopper 114 jump up and down as a result of the "kicking" action of second projectile guide member 144, they come back down with their tips oriented properly, i.e., pointing forward toward barrel 106. Specifically, collapsible ceiling assembly 166 ensures the proper orientation of the darts in hopper 114 by preventing the darts from jumping up a distance that is greater than their length when they are agitated by the "kicking" action of second projectile guide member 144.

In operation, after darts have been loaded into hopper 114 and cover 116 and rear wall assembly have been locked into place in the manner described above, gravity causes collapsible ceiling assembly 166 to expand as nested members 170, 172, 174, 176 drop within the interior of hopper 114. As a result, descending ceiling plate 178 comes to rest on top of the pile of darts housed in hopper 114. The amount of weight applied to the pile of darts by descending ceiling plate 178 is heavy enough to prevent the darts from jumping up and down within hopper 114 while they are being agitated by the "kicking" action of second projectile guide member 144, but at the same time is light enough not to interfere with the "kicking" action of second projectile guide member 144 described above.

As a user fires darts from launcher 100, the level of darts inside hopper 114 drops. Nested members 170, 172, 174, 176 will drop further into the interior of hopper 114, in accordance with the drop in the level of darts inside hopper 114, so that descending ceiling plate 178 remains atop the pile of darts at all times when cover 116 is closed.

In alternative embodiments, collapsible ceiling assembly 166 may include a lightweight extension spring instead of nested members 168, 170, 172, 174, 176. The extension spring may be coupled at one end to the underside of cover 116 and at its other end to descending ceiling plate 178. In such alternative embodiments, gravity again causes collapsible ceiling assembly 166 to expand as the spring extends into the interior of hopper 114 so that descending ceiling plate 178 again comes to rest on top of the pile of darts housed in hopper 114.

As described herein, the embodiments in accordance with the present invention provide an elegant and economical solution to the problem of providing a toy projectile launcher, e.g., a toy foam dart launcher, that can launch a substantially large number of projectiles without reloading. While this invention has been described in conjunction with the embodiments outlined above, it is evident that many alternatives, modifications and variations will be apparent to those skilled in the art. Accordingly, the embodiments of the invention, as set forth above, are intended to be illustrative, not limiting. Various changes may be made without departing from the spirit and scope of the invention.

What is claimed is:

1. A toy projectile launcher, comprising:

a housing defining an elongated interior recess; and a hopper coupled to the elongated interior recess, the hopper configured to house one or more projectiles and to provide the one or more projectiles to the elongated interior recess from a bottom of the hopper so that they can be launched from the housing, wherein the hopper comprises:

a wall located to one side of the elongated interior recess when the elongated interior recess is viewed along its length in a direction of projectile launch, wherein the wall extends upwardly relative to the bottom of the hopper; and an agitating member rotatably coupled to the wall and configured to loosen the one or more projectiles within the hopper, and a wheel having a finger extending therefrom, wherein the agitating member is agitated by intermittent contact between the finger and the agitating member.

2. The toy projectile launcher of claim 1, wherein the agitating member comprises an opening.

3. The toy projectile launcher of claim 2, wherein the wheel protrudes through the opening in the agitating member.

4. The toy projectile launcher of claim 3, wherein the agitating member is agitated as a result of contact between the finger and an edge of the opening in the agitating member.

5. The toy projectile launcher of claim 1, wherein the agitating member slopes downwardly from the wall to the housing to guide the one or more projectiles into the housing.

6. The toy projectile launcher of claim 5, wherein:

the interior recess of the housing includes a firing chamber; and the agitating member guides the one or more projectiles into the firing chamber.

7. The toy projectile launcher of claim 6, wherein the firing chamber comprises a rotating track to advance the one or more projectiles from the firing chamber.

8. The toy projectile launcher of claim 1, wherein the one or more projectiles are provided to the interior recess of the housing one at a time.

9. The toy projectile launcher of claim 1, wherein the agitating member is coupled to the wall by a hinge.

10. The toy projectile launcher of claim 1, wherein the one or more projectiles comprise toy foam darts.

11. A toy projectile launcher, comprising:

a housing defining an elongated interior recess;

a hopper coupled to the elongated interior recess, the hopper configured to house one or more projectiles and to provide the one or more projectiles to the housing directly from a bottom of the hopper so that they can be launched from the housing, wherein the hopper comprises:

a wall located to one side of the elongated interior recess when the elongated interior recess is viewed along its length in a direction of projectile launch, wherein the wall extends upwardly relative to the bottom of the hopper; and an agitating member rotatably coupled to the wall and configured to loosen the one or more projectiles within the hopper, a wheel having a finger extending therefrom, wherein the agitating member is agitated by intermittent contact between the finger and the agitating member;

a cover having an underside which faces into the hopper; and a ceiling collapsibly attached to the underside of the cover.

12. The toy projectile launcher of claim 11, wherein the ceiling comprises a plurality of nested members attached to the underside of the cover.

13. The toy projectile launcher of claim 12, wherein the plurality of nested members expands into the hopper when the cover is closed.

14. The toy projectile launcher of claim 13, wherein the ceiling rests on top of the one or more projectiles housed in the hopper.

15. The toy projectile launcher of claim 11, wherein the ceiling comprises a spring attached to the underside of the cover.

16. A toy projectile launcher, comprising:

a housing defining an elongated interior recess; and a hopper coupled to the elongated interior recess, the hopper configured to house one or more projectiles and to provide the one or more projectiles to the housing from a bottom of the hopper so that they can be launched from the housing;

wherein the hopper comprises;

a first wall located to one side of the elongated interior recess when the elongated interior recess is viewed along its length in a direction of projectile launch, the wall extending upwardly relative to the bottom of the hopper;

an agitating member rotatably coupled to the first wall and configured to loosen the one or more projectiles within the hopper;

a wheel having a finger extending therefrom, wherein the agitating member is agitated by intermittent contact between the finger and the agitating member; and a second wall that is rotatably coupled to the housing and is movable to a degree that accommodates entry of a partially closed fist of a user into the hopper to facilitate loading of the one or more projectiles into the hopper.

17. The toy projectile launcher of claim 16, wherein the second wall is rotatable about the housing for a predetermined distance.

18. The toy projectile launcher of claim 16, wherein the second wall comprises a rear wall of the hopper.

19. The toy projectile launcher of claim 18, further comprising a cover for the hopper that is rotatably coupled to the rear wall.

20. A toy projectile launcher, comprising:

a housing;

a firing chamber disposed within the housing and configured to receive a projectile;

a rotating track defining a bottom of the firing chamber, the rotating track receiving the projectile thereon;

a launching mechanism disposed forward of the rotating track for launching the projectile; and a push rod;

wherein the push rod and the rotating track cooperate to advance the projectile from the firing chamber to the launching mechanism.

21. The toy projectile launcher of claim 20, wherein the push rod pushes the projectile as the projectile is being advanced from the firing chamber by the rotating track.

22. The toy projectile launcher of claim 21, wherein a tip of the push rod extends into the firing chamber.

23. The toy projectile launcher of claim 22, wherein a tip of the push rod extends halfway into the firing chamber.

24. The toy projectile launcher of claim 20, wherein the push rod comprises a reciprocating push rod.

25. The toy projectile launcher of claim 24, wherein the push rod reciprocates toward and away from the firing chamber.

26. The toy projectile launcher of claim 20, wherein the firing chamber is configured to receive one projectile at a time.

* * * * *